US005715953A

United States Patent [19]

Brown

[11] Patent Number: 5,715,953

[45] Date of Patent: Feb. 10, 1998

[54] BEVERAGE SERVICE FRAMEWORK

[76] Inventor: John R. Brown, 9050 Seward Park Ave S. #35, Seattle, Wash. 98118

[21] Appl. No.: 657,698

[22] Filed: May 29, 1996

[51] Int. Cl.[6] ..... A47F 7/00

[52] U.S. Cl. ..... 211/74

[58] Field of Search ..... 211/74, 71, 13, 211/71.01, 126, 133; D6/396, 512; D7/500, 505, 507, 300, 590, 598

[56] References Cited

U.S. PATENT DOCUMENTS

| | | | |
|---|---|---|---|
| D. 307,373 | 4/1990 | Bearak | D7/701 |
| D. 353,747 | 12/1994 | Lanier | D7/701 |
| 4,334,623 | 6/1982 | Geary | 211/71 |
| 4,515,334 | 5/1985 | Horne | 211/74 |
| 4,546,883 | 10/1985 | Youngdale | 211/74 |
| 4,700,849 | 10/1987 | Wagner | 211/74 |
| 5,096,246 | 3/1992 | Cnare | 206/426 |
| 5,180,066 | 1/1993 | McArdle | 211/74 |
| 5,197,612 | 3/1993 | Thomson | 211/74 |
| 5,219,072 | 6/1993 | Sauer | 206/139 |

FOREIGN PATENT DOCUMENTS

| | | | |
|---|---|---|---|
| 127343 | 4/1956 | France | 211/74 |
| 1577962 | 7/1969 | France | 211/74 |
| 2244205 | 11/1991 | United Kingdom | 211/74 |

OTHER PUBLICATIONS

The Wine Enthusiast ®;1995, vol.35.No.2: Vintage Butler(pp. 46.47) Vine Cooler(p.47), Vintage Keeper(p.43), Wine Luggage(p.40), Marble and Brass Wine Display(p.38), Beechwood Wine Bar(p.35) Bottle Caddy(p.32), Pyramid Wall Galllery(14), Picnic Basket(p.40), Quartet Picnic Set (p.40).

*Primary Examiner*—Alvin C. Chin-Shue
*Assistant Examiner*—Sarah L. Purol

[57] ABSTRACT

A beverage service framework is provided which is easily and safely portable using one hand for carrying a beverage container, stemmed glasses, and other service items. The base of the framework is designed to securely retain an unopened beverage container in approximately horizontal orientation and to securely retain a beverage container opener, foil cutter, drip collar, napkins, and coasters. The base alternatively supports an open beverage container standing upright. The base is connected by one or more columns to a top member forming a carrying handle whereon are mounted a plurality of retainers for securely retaining inverted stemmed glasses, thus providing all items necessary for a comprehensive beverage service.

12 Claims, 4 Drawing Sheets

BEVERAGE SERVICE FRAMEWORK

BACKGROUND OF THE INVENTION

Related work of ours: None.

1. Field of the Invention

This invention relates to a beverage service, specifically a framework for safely and conveniently hand-carrying a beverage container, stemmed glasses, and an opener and other items necessary for a comprehensive yet portable beverage service.

2. Description of the Related Art

During research for prior art in PTO and trade journals, many examples of wine racks, glass racks, bottle carriers, service trays, beverage carts and mobile bars were found. The closest related art found were Youngdale U.S. Pat. No. 4,546,883, Wagner U.S. Pat. No. 4,700,849, Vitrac # 1,127,343, (Fr), Noiret # 1,577,962 (Fr), and Yip # 2,244,205 (UK).

Youngdale shows an A-frame assembly for containing four wine bottles in horizontal orientation and six glasses suspended from their bases. A shipping container for packing and transporting the A-frame and glasses is included in the invention.

Wagner shows a wine rack and stemware rack in combination, but fixed to the under side of a cabinet.

Vitrac shows a cart that rolls on the floor to transport beverages, glasses, and a cooling bucket (as required by French law) for serving drinks in hotels and restaurants.

Noiret shows a portable bar for transporting multiple bottles and glasses. An inner wire frame lifts up for transportation and drops down and rotates to present glasses and facilitate serving of drinks.

Yip shows a spirit warming set comprising a bottle holder, means for storing glasses, and a heating arrangement for heating and serving brandy, Chinese spirits, and sake.

Wine Luggage (see the Win Enthusiast, Vol. 35, No. 2) is an insulated case to keep two standard bottles of wine chilled, hold four special glasses and a special corkscrew, and provide safe transport to "business meetings and family outings".

Vine Cooler (Wine enthusiast Vol. 35, No. 2) is a jacket for keeping wine chilled in a table top holder.

Vintage Butler (Wine Enthusiast Vol. 35, No. 2) is a sculptured wrought iron bottle holder with pouring handle, wherein a wine bottle is held at a slant.

Marble and Brass Wine Display (Wine Enthusiast Vol. 35, No. 2) is a bottle display only with no handle and no provision for retention of other beverage service items.

IKEA bottle holder (IKEA Home Furnishings) is chrome plated rod formed to retain one bottle at a slant, including a handle for pouring, similar to Vintage Butler.

The research showed no examples of a beverage service that can be easily carried with one hand when fully loaded and thus is suitable for use at a home or restaurant table, that securely retains a beverage container, stemware, and opener and other items necessary for a comprehensive beverage service, and that is safe to use in carrying, displaying, and dispensing modes.

OBJECTS AND ADVANTAGES

Accordingly, the present invention is directed to the provision of a comprehensive, portable beverage service framework which efficiently stores and displays a beverage container and stemmed glasses and assists in the movement and dispensing of a beverage container, stemmed glasses, and an opener and other service items to and at the area of consumption. The object of the invention is to provide a single framework forming a first retention means for a beverage container, a second retention means for a plurality of stemmed glasses, a third retention means for a beverage container opener and other small items, and carrying means for safely hand-carrying the framework and the items retained therein to provide a comprehensive, stable, compact and light weight thus fully portable and easy to use beverage service framework.

In a preferred embodiment of the invention, the first retention means holds a beverage container in approximately horizontal orientation and consists of a base forming a cradle with side members, end members and base plate member to prevent lateral, downward and longitudinal movement of a beverage container, specifically for a bottle with a neck during storage, display, and carrying from one location to another. As such, an advantage of the invention is that the bottle is securely cradled and elevated above the base plate, thereby providing space for storage of other items such as opener, foil cutter, drip collar, coasters, and napkins below the bottle and in the tray formed by the base plate, side, and end members. A further advantage is that the neck of the bottle is slightly elevated at an angle which permits the label to be easily read while at the same time, in the particular case of a bottle with a cork, the angle causes the gasses inside the bottle to be trapped in the shoulder away from the neck and thus causes the liquid contents of the bottle to keep the cork wet. A beverage container support means consists of a base plate, the object of which is to hold an open beverage container in upright position to permit breathing (in the case of a beverage such as wine) and minimize the chance of spilling the contents of any open beverage container. Carrying means is a handle connected to the base by one or more columns such that the center of the handle is approximately over the center of gravity of the framework when loaded, thereby providing stability, balance, and additional safety when being hand carried. The second retention means holds stemmed glasses with a base in inverted orientation and consists of approximately horizontal members joined to the framework near the top of the columns and near the ends of the handle. This second retention means consists of openings located at each end of the horizontal members. This placement yields several advantages in that the horizontal members are suitable spaced apart for a human hand to fit between and grasp the handle and are suitably spaced apart and elevated for the bowls of inverted stemmed glasses to hang below without making contact with the beverage container, the base, or each other. In a preferred embodiment, the second retention means consists of stemware hangers having a plurality of keyhole shaped openings each with a tapered outer portion to receive the stem of a glass and retain the glass in an enlarged inner portion of the keyhole. The keyhole shaped opening has the advantage that the inner part provides a stable seating for the base of an inverted stemmed glass. The tapering of the outer part helps guide the narrow portion of the stem into the keyhole and retains the wider portion of the stem at the junction of the stem and base when the inverted stemmed glass is seated in the enlarged inner portion of the keyhole.

These and other objects and advantages will be more fully apparent from the ensuing disclosure and appended claims.

BRIEF DESCRIPTION OF THE DRAWINGS

The following drawings show the preferred embodiments of the invention.

Figure 1:
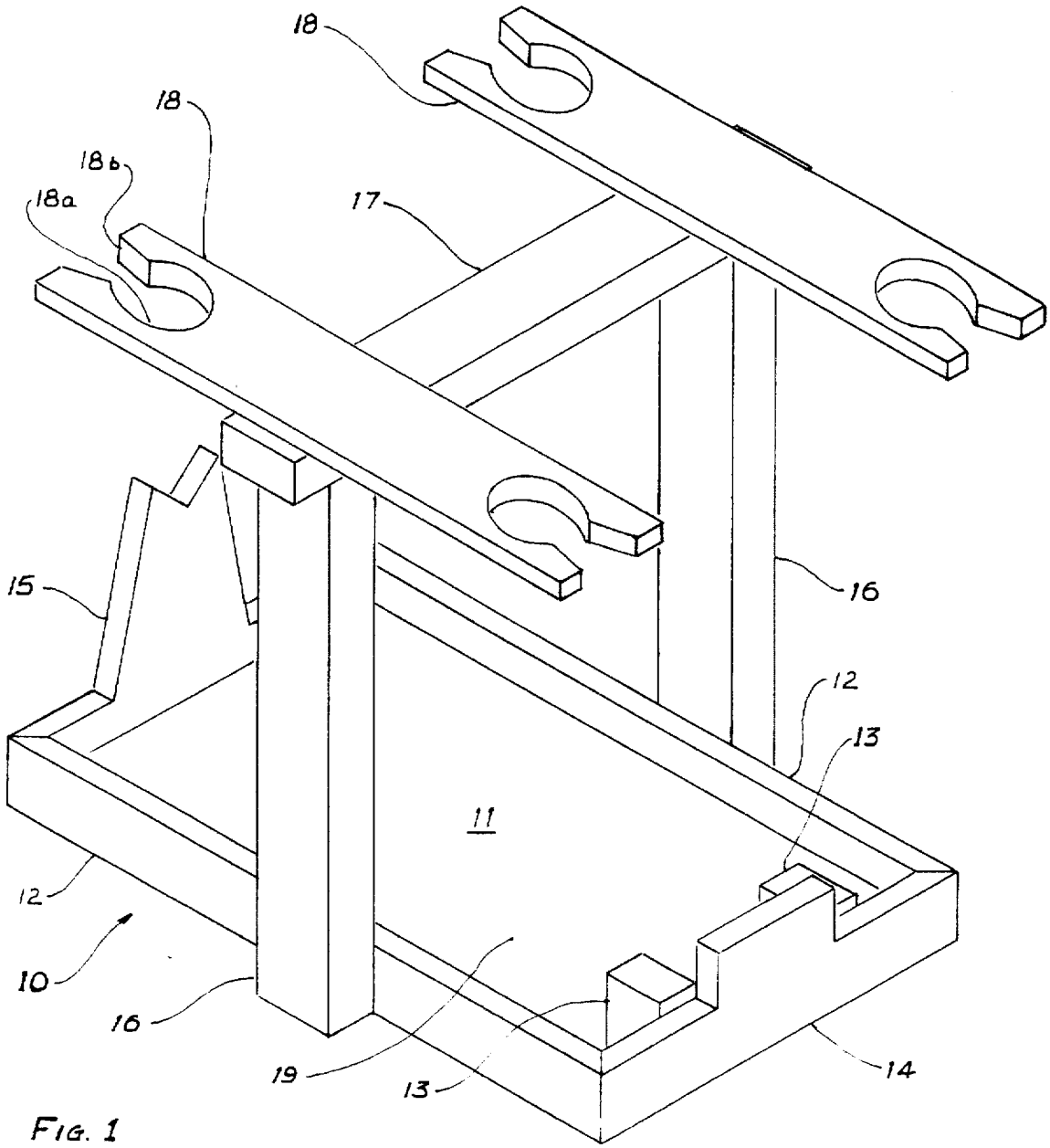
FIG. 1 is a perspective view of the beverage service framework according to the invention including a first stemware hanger embodiment.

| List of Reference Numerals | |
|---|---|
| 10 | beverage service framework |
| 11 | base |
| 12 | base side |
| 13 | bottom lateral retainer |
| 14 | base front |
| 15 | base rear |
| 16 | column |
| 17 | handle |
| 18 | stemware hanger |
| 18a | enlarged inner portion of opening |
| 18b | tapered outer mouth portion of opening |
| 18c | raised portion |
| 18d | L-shaped raised portion |
| 18e | pivoting stemware base retainer stop |
| 19 | base plate |
| 20 | insert |
| 20a | insert opening |
| 20b | insert seat |
| 20c | insert flexible flap |
| 21 | pivoting stemware base retainer |
| 21a | retainer C-shaped end |
| 21b | retainer lever arm |
| 22 | pivot pin |

DETAILED DESCRIPTION OF PREFERRED EMBODIMENTS

As shown in FIG. 1, the invention beverage service framework 10 includes frame members 12, 13, 14, 15 and 19 which form the base 11; columns 16; handle 17; and stemware hangers 18. The various members may be formed of any suitable materials and members may be combined or divided to suit manufacturing. The beverage service framework includes two members 12, two members 13, two members 16, and one or more members 18. Member 14 is suitably joined to members 12 to form the front of the base. Member 15 is suitably joined to the other end of members 12 to form the rear of the base. Member 19 is suitably joined to members 12, 14, and 15 to form the bottom of the base 11. Members 13 are suitably joined to either the base front 14 or base plate 19 or both and are suitably spaced apart to vertically support and laterally restrain the bottom of the beverage container. Member 14 is of a height suitable to longitudinally restrain the bottom of the beverage container. Member 15 has a notch in its upper edge to receive the neck of a beverage container.

Members 13, 14 and 15 are preferably arranged so that the beverage container is cradled and longitudinally and laterally restrained with its neck slightly elevated. Members 12, 14, 15, and 19 are preferably arranged such that the beverage container opener and other beverage service items may be retained in the tray formed by the base beneath the elevated bottle. Members 16 are joined to members 12 so that members 16 are upstanding, and member 17 is joined to the upper ends of members 16 so that the center of member 17 is approximately above the center of gravity of the loaded framework. Members 18 are joined to member 17 so that they are approximately over members 16 and approximately parallel to members 12. Members 18 have openings in their ends to receive and retain stemware in inverted orientation.

Figure 2:
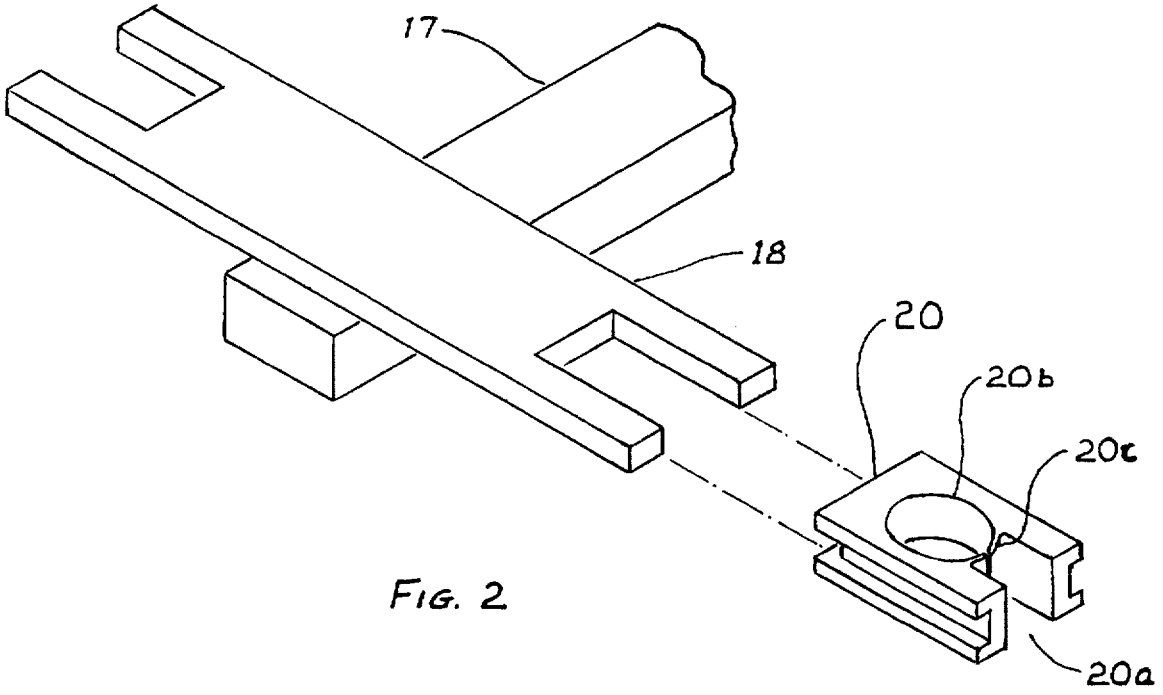
FIG. 2 is a perspective view of a second stemware hanger embodiment.
Figure 3:
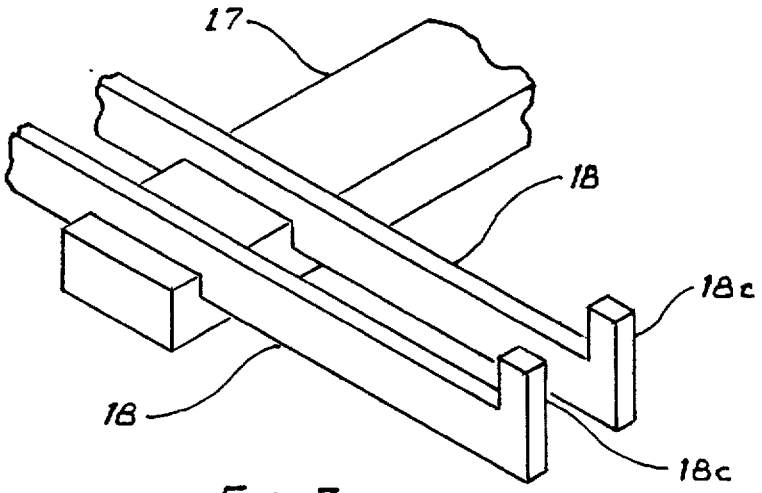
FIG. 3 is a perspective view of a third stemware hanger embodiment.
Figure 4:
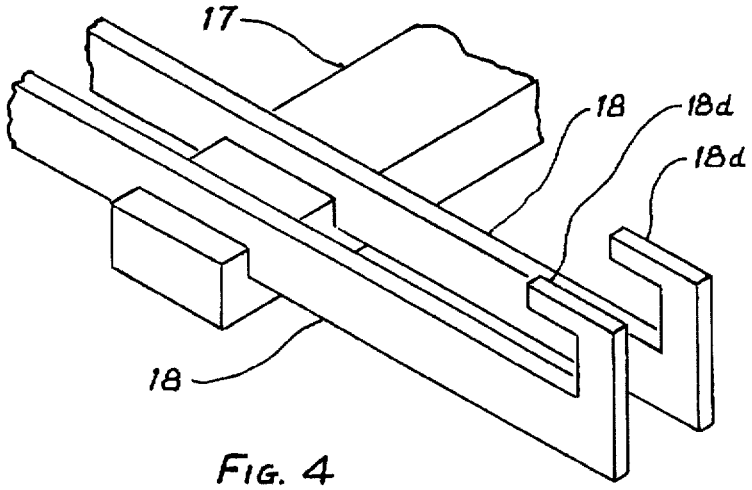
FIG. 4 is a perspective view of a fourth stemware hanger embodiment.
Figure 5:
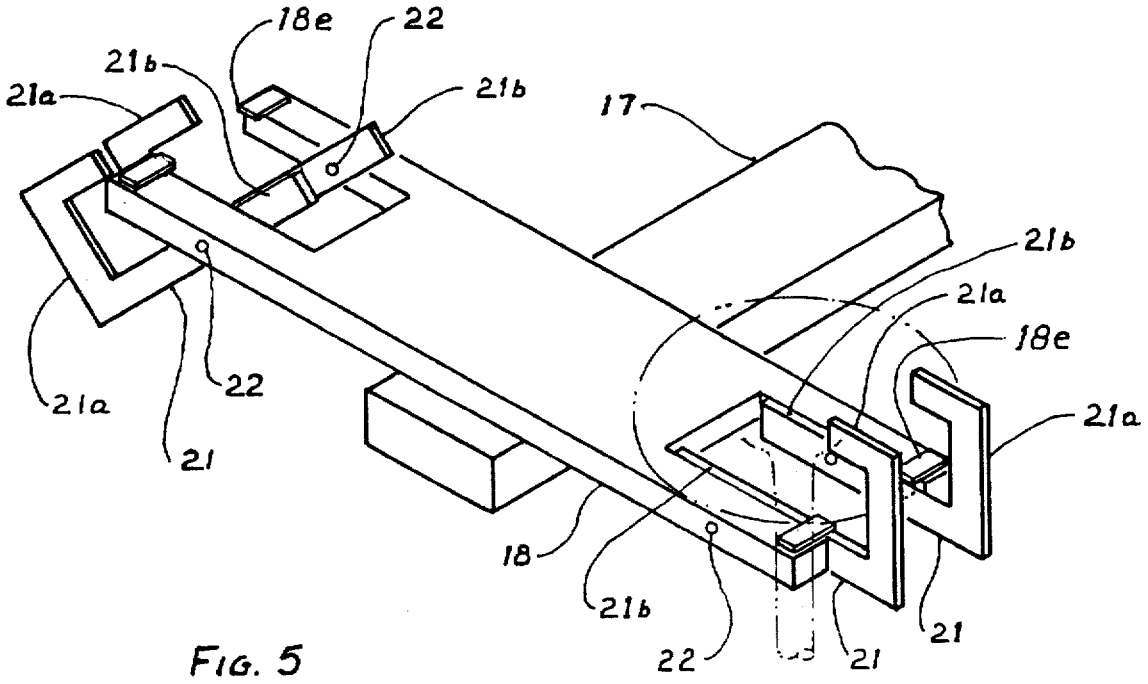
FIG. 5 is a perspective view of a fifth stemware hanger embodiment.

In a first embodiment of the stemware hanger 18, the openings are shaped like keyholes with the inner portion (**18*a*) of the opening being enlarged and the mount (18*b*) of the opening tapered, as shown in FIG. 1. The tapered opening helps guide the stem of an inverted stemmed glass into the enlarged inner portion and retains the wider portion of the stem when the base of the inverted glass is seated in the enlargement. In a second embodiment, shown in FIG. 2, openings in the stemware hangers are fitted with inserts 20. Each insert has an opening (20*a*), a seat (20*b*), and one or more flexible flaps (20*c*) attached to either side of the opening such that the flaps serve to receive and retain the stem, and the seat supports the base of a stemmed glass in inverted orientation. In a third embodiment, shown in FIG. 3, the ends of the stemware hangers have raised portions (18*c*) which restrain the edge of the stemmed glass base and thus restrain the glass from leaving the opening without first being lifted up to clear the raised portions. In a fourth embodiment, shown in FIG. 4, the ends of the stemware hangers have substantially L-shaped raised portions (18*d*) which restrain the edge and extend partially over the base of the stemmed glass and thus restrain the glass from inadvertent upward and outward movement. In a fifth embodiment, shown in FIG. 5, openings in the stemware hangers are fitted with one or more pivoting stemware base retainers 21. The pivoting stemware base retainer has a C-shaped outer end (21*a*) and a lever arm (21*b*) forming the inner end. The pivoting stemware base retainers are suitably attached with pivot pins 22 to the stemware hangers such that the heavier outer ends of the retainers swing down to permit easy insertion and removal of an inverted stemmed glass, and swing up when the weight of the stemmed glass is resting on the lever end. The pivoting stemware base retainer swings up only to a position such that is approximately parallel with the stemware hanger due to coming into contact with the pivoting stemware base retainer stop (18*e***). In this way, the C-shaped outer end extends partly over the base of the stemmed glass to restrain it from inadvertent upward and outward movement.

Figure 6:
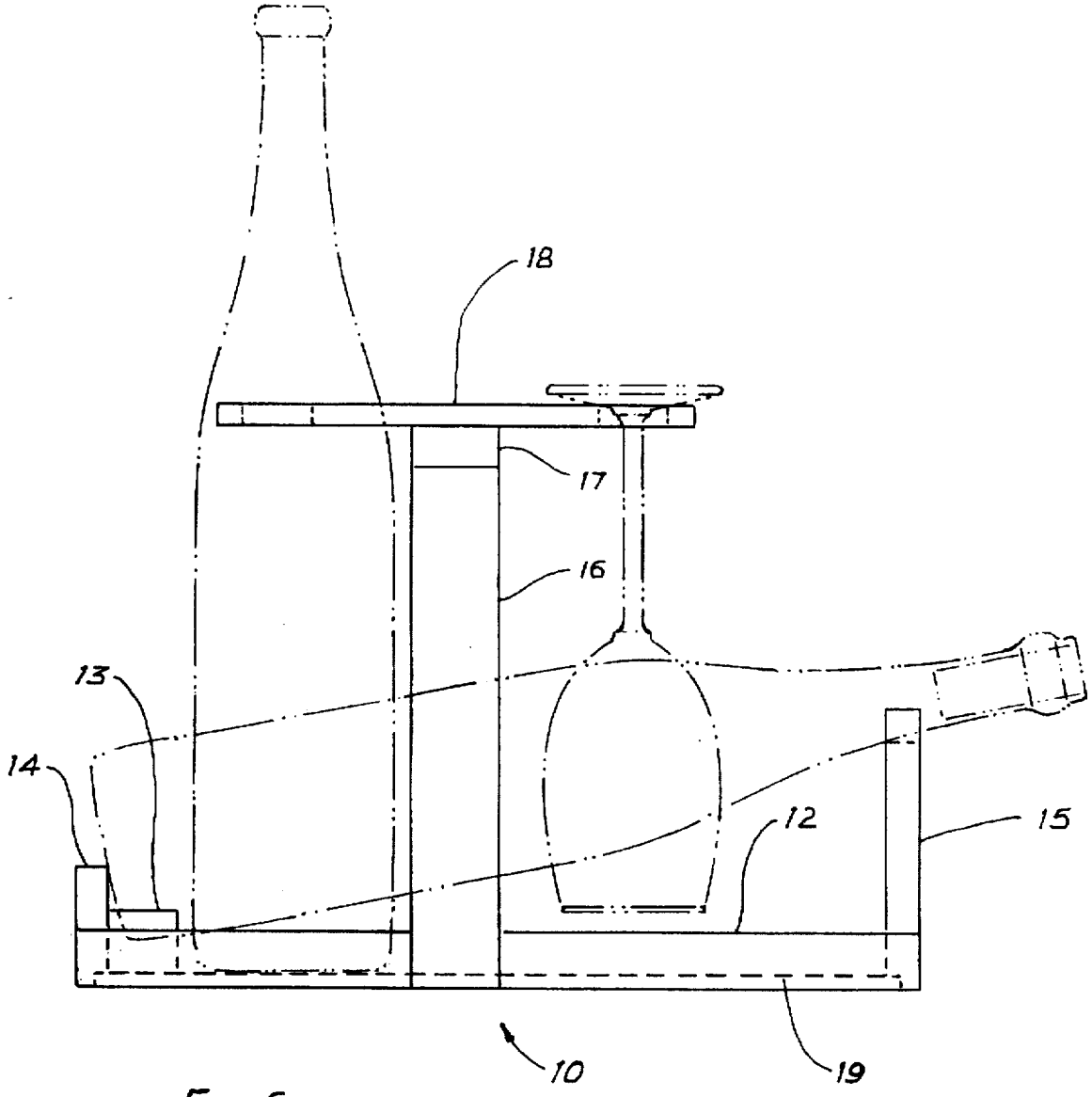
FIG. 6 is a side elevation of the beverage service framework showing alternative beverage container positions and showing an inverted stemmed glass seated in a stemware hanger.

As illustrated in FIG. 6, member 19 is preferably arranged to support and upright open beverage container.

We claim:

1. A beverage service framework comprising:

A. a first retention means comprising a base of said framework for securely retaining a beverage container in an approximately horizontal orientation within said framework;

B. support means comprising a base plate of said base for supporting said beverage container in upright orientation;

C. a second retention means comprising stemware hangers for securely retaining a plurality of stemmed glasses in inverted orientation; said stemware hangers having one or more openings wherein said one or more openings are fitted with an insert comprising a mouth, a seat, and one or more flexible flaps across said mouth to receive and retain said stem and support said base of said stemmed glasses in said inverted orientation in said seat;

D. a third retention means comprising said base of said framework for securely retaining an opener, foil cutter, drip collar, napkins, and coasters as necessary for a comprehensive beverage service;

E. framework carrying means comprising a handle that in combination with said base and said stemware hangers provides for safe, one-handed carrying of a fully loaded beverage service framework.

2. A beverage service framework according to claim 1 wherein said first retention means comprises said base forming longitudinal, lateral, and downward beverage container bottom retention means extending orthogonally to said base at front end of said base and lateral and downward beverage container top retention means extending orthogonally to said base at rear end of said base.

3. A beverage service framework according to claim 2 wherein said beverage container top retention means comprises a notch in the upper edge of said rear end of said base for receiving said beverage container near top of said beverage container.

4. A beverage service framework according to claim 1 wherein said support means comprises the upper surface of said base plate of said base for supporting said beverage container in upright orientation.

5. A beverage service framework according to claim 1 wherein said second retention means comprises said stemware hangers suitably joined to said framework near top of said framework.

6. A beverage service framework according to claim 5 wherein said stemware hangers are in a substantially horizontal orientation said one or more openings adapted to receive the stem and support the base of said stemmed glasses and further adapted to securely retain said stemmed glasses in inverted orientation.

7. A beverage service framework according to claim 6 wherein said openings are keyhole shaped slots with enlarged inner portions adapted to retain the wider portion of said stem at the unction of said stem and said base of said stemmed glasses when seated in said enlarged inner portion and with tapered outer portions adapted to accept the narrow portion of said stem and facilitate insertion of said stemmed glasses into said keyhole shaped slots.

8. A beverage service framework according to claim 6 wherein the ends of said stemware hangers define raised portions adapted to retain said base of said stemmed glasses within said openings.

9. A beverage service framework according to claim 8 wherein said raised portions are adapted to extend horizontally inward over said base of said stemmed glasses when inverted and securely restrain said stemmed glasses from inadvertent upward and outward movement.

10. A beverage service framework according to claim 6 wherein said openings are fitted with pivoting stemware base retainers comprising a lever arm and a C-shaped outer end and suitably joined to said stemware hangers with pivot pins wherein said pivoting stemware base retainers are adapted to receive said stem and retain said base of said stemmed glasses in inverted orientation using the weight of said stemmed glasses on said lever arm to rotate said C-shaped outer end of said pivoting stemware base retainer and using a pivoting stemware base retainer stop to cause said pivoting stemware base retainer to stop said pivoting stemware base retainer from rotating when said C-shaped outer end extends horizontally inward over said base of said stemmed basses and thereby restrains said stemmed glasses from inadvertent upward and outward movement.

11. A beverage service framework according to claim 1 wherein said third retention means for an opener, foil cutter, drip collar, napkins, and coasters comprises a tray formed by said base of said framework.

12. A beverage service framework according to claim 1 wherein said framework carrying means comprises a substantially horizontal handle member suitably joined to one or more column members and with said column members joined to said base of said framework to place the center of said handle member substantially over the center of gravity of said framework when loaded whereby a fully loaded beverage service framework can be safely and easily carried with one hand.

* * * * *

UNITED STATES PATENT AND TRADEMARK OFFICE

CERTIFICATE OF CORRECTION

PATENT NO. : 5,715,953

DATED : February 10, 1998

INVENTOR(S) : John R. Brown & Graham D. Clapp

It is certified that error appears in the above-identified patent and that said Letters Patent is hereby corrected as shown below:

TITLE PAGE:

Item [76] Inventor: Add Graham D. Clapp, 1011 McGilvra Blvd., Seattle, Wash. 98112

Column 1, Line 39: Change 'Win' to -Wine-

Column 2, Line 46: Change 'suitable' to -suitably-

Column 4, Line 42: After 'such that' insert -it-

Column 4, Line 49: Change 'and' to -an-

Column 5, Line 38: Change 'unction' to -junction-

Column 6, Line 24: Change 'basses' to -glasses-

Signed and Sealed this

Fourteenth Day of April, 1998

Bruce Lehman

*Attest:*

BRUCE LEHMAN

*Attesting Officer*

*Commissioner of Patents and Trademarks*